US006082026A

United States Patent [19]

Sand et al.

[11] Patent Number: 6,082,026

[45] Date of Patent: Jul. 4, 2000

[54] SNOWBOARD BOOT ANKLE SUPPORT ASSEMBLY

[75] Inventors: Jeff W. Sand, San Francisco; Theodore W. Barber, Belmont, both of Calif.

[73] Assignee: Vans, Inc., Santa Fe Springs, Calif.

[21] Appl. No.: 09/341,070

[22] PCT Filed: Jan. 15, 1998

[86] PCT No.: PCT/US98/00336

§ 371 Date: Jul. 2, 1999

§ 102(e) Date: Jul. 2, 1999

[87] PCT Pub. No.: WO98/31247

PCT Pub. Date: Jul. 23, 1998

Related U.S. Application Data

[60] Provisional application No. 60/035,619, Jan. 17, 1997.

[51] Int. Cl.[7] ..... A43B 7/20; A43B 5/04

[52] U.S. Cl. ..... 36/89; 36/117.1; 36/117.8; 36/118.2

[58] Field of Search ..... 38/89, 118.2, 117.1, 38/117.8, 115; 602/29

[56] References Cited

U.S. PATENT DOCUMENTS

| | | |
|---|---|---|
| 2,972,822 | 2/1961 | Tanner . |
| 3,530,594 | 9/1970 | Vogel . |
| 3,597,862 | 8/1971 | Vogel . |
| 3,807,062 | 4/1974 | Spier . |
| 4,096,651 | 6/1978 | Ancker . |
| 5,056,509 | 10/1991 | Swearington . |
| 5,090,138 | 2/1992 | Borden . |
| 5,435,080 | 7/1995 | Meiselman . |
| 5,454,173 | 10/1995 | Falguere et al. . |
| 5,499,461 | 3/1996 | Danezin et al. . |
| 5,505,477 | 4/1996 | Turner et al. . |
| 5,692,765 | 12/1997 | Laughlin . |
| 5,771,609 | 6/1998 | Messmer . |

FOREIGN PATENT DOCUMENTS

| | | |
|---|---|---|
| 0 524 544 A1 | 1/1993 | European Pat. Off. . |
| 0 646 334 B1 | 4/1995 | European Pat. Off. . |
| 0 772 982 A2 | 5/1997 | European Pat. Off. . |
| 36 22 746 A1 | 1/1988 | Germany . |

*Primary Examiner*—Ted Kavanaugh
*Attorney, Agent, or Firm*—Fish & Richardson P.C.

[57] ABSTRACT

An ankle support assembly for use in combination with a soft-style snowboard boot. The assembly includes a rigid heel cup and a high back support for supporting the calf region of the snowboard rider. The high back support includes an extension member having a bottom end portion that is coupled within a pocket formed in the upper rear region of the heel cup. The coupling permits the high back support to float about a pivot axis that is translatable a predetermined amount along transverse, longitudinal and vertical axes of the ankle support assembly so as to enable articulation of said ankle support device in a manner that closely approximates the articulation of the foot and ankle of the snowboard rider. A tether is provided to prevent inadvertent decoupling of the high back support from the heel cup. Also included is a length adjustable tension cable to provide forward lean adjustment for the assembly.

16 Claims, 3 Drawing Sheets

SNOWBOARD BOOT ANKLE SUPPORT ASSEMBLY

This is a 371 application of PCT/US98/00336 filed on Jan. 15, 1998, which the PCT is claiming priority of Provisional Application 60/035,619 filed on Jan. 17, 1997.

TECHNICAL FIELD

The present invention relates generally to improvements in soft-style snowboard boots of the kind that include an interface to a binding element affixed to a part of the boot for use in combination with step-in snowboard bindings. More particularly, the present invention relates to an internal ankle support assembly for use in combination with a soft snowboard boot, wherein the assembly is effective to lock out forward extension movement of the snowboard rider's ankles, and is effective to closely approximate the articulation of the foot and ankle of the snowboard rider.

BACKGROUND OF THE INVENTION

Snowboard boots generally fall into one of two categories: "hard-style" or "soft-style" boots. Hard snowboard boots are the preferred boot for downhill riding. The construction of hard snowboard boots is similar to that of conventional ski boots. Plate bindings are used for attaching the hard boots to the snowboard.

Soft-style snowboard boots are the preferred boot for freestyle riding. The construction of the soft boot design is characterized by a flexible boot upper which permits high lateral mobility to accommodate the ankle and calf movement of the rider during freestyle maneuvers. Common binding types for attaching the soft-style snowboard boot to the snowboard include external strap bindings and step-in bindings.

It is well recognized in the art that soft-style snowboard boots require support in the calf region in order to lock out forward extension of the ankle in order to facilitate tipping the board on edge when executing a back side or heel side turn.

In the past, this support was provided by the high back structure of conventional strap bindings. The high back structure effectively locks out the forward extension movement of the ankle, while side-to-side rotation of the ankle and foot is permitted (as allowed by the flexibility of the boot/ankle). Without this flexibility, the rider's ability to optimally control board position and bodily stance is diminished. This is especially detrimental to "freestyle" riding, where quick turns and stunts require a high degree of side-to-side ankle/foot flexibility.

In the case of step-in bindings, there is no external high back. Therefore, an essential feature to the design of a soft-style boot for step-in bindings is the relocation of the external high back support structure found on conventional (strap-type) bindings to the interior of the boot. This structure allows the rider to efficiently apply a rearward force (towards the back edge of the snowboard) which is critical in providing control while riding. The high back is fixed at a particular angle in relation to the board, such that a force applied "backwards" to the high back (relative to the boardrider), with the board pivoting about an axis through the heel side edge, will pull the front of the board upwards. The rider simply leans backwards, pushing the high back backwards, which then "tips" the board up onto the heel side edge. Without such a structure, the rider would have to pull the toe edge of the board upwards using his leg muscles. The high back structure effectively "locks out" the forward extension of the ankle. However, as the boot is not attached to the external high back, lateral and medial rotation of the ankle/foot is not inhibited by the high back.

The internal high back support structure should provide similar effectiveness of ankle lock out as an external high back while also allowing relatively free side-to-side rotation of the ankle/foot. Thus, the provision of an integral structure in a soft-style snowboard boot which provides similar support as an external high back while still allowing lateral/medial flexibility would be a highly desirable feature.

For the case of conventional strap bindings with external high back support, the amount of forward lean is determined by the angle of the external high back, which is not itself attached to the boot. Therefore, lateral/medial rotation of the ankle/foot does not affect the amount or degree of forward lean imparted by the high back, and vice-versa. Forward lean and lateral/medial ankle/foot rotation are effectively isolated from one another. Without this isolation, the rider's freedom of movement/board stance and degree of control are diminished. A high back/forward lean structure that is integral to the boot must effectively retain this independence between forward lean and lateral/medial ankle/foot rotation.

From published European Patent Application EP 0 646 334 A1, there is disclosed a high back support insert for a soft-style snowboard boot which is adapted to be placed between the flexible outer boot portion and the soft padded inner boot portion. The insert includes a heel cup/foot bed portion which is pivotally connected to an upper high back portion at the height of the ankle about an axis extending in the longitudinal axis of the boot plane. A pair of lengthwise adjustable straps connect opposite sides of the foot bed portion (at the ball of the foot region) to respective opposite sides of the high back. A shortening adjustment of the straps provides a change in the forward lean of the boot insert by pulling the upper high back portion forwardly toward the toe end of the heel cup foot bed portion of the boot insert.

Blax of Germany is currently selling a version of this type of high back soft boot insert under the name of I-SPINE. The Blax system utilizes a single direction tension adjustment via a ladder strap that runs vertically up the back of the ankle. In the Blax design, the fixed pivot location between the high back and heel cup means that the presence of high back is always "felt" by the rider. In toe side turns, the fixed pivot restrains the high back and does not allow it to follow the forward lean of the rider's ankle. In view of the fixed pivot feature, this design feels mechanical and limiting as it does not closely mimic the rolling articulation of the foot and ankle. It is noted that the ankle joint has a very limited amount of side-to-side angular rotation. The side-to-side flexibility of the ankle/foot is mostly achieved by rotation/articulation of the structure of the foot.

Accordingly, an ankle support device for a soft-style snowboard boot which provides high back support needed for heel side turning and which also closely approximates the rolling articulation or the ankle and foot during side to side movements and toe side turning would constitute a significant advance in the art.

SUMMARY OF THE INVENTION

Briefly, the invention discloses a multi-piece support system consisting of a rigid heel cup, a stiff high back, and an adjustable forward lean strap or cable.

The heel cup is designed with a pocket on the upper back edge into which fits the rounded bottom end of the high back. The bottom end of the high back is coupled securely within the pocket, yet is free to roll and shift from side to side, allowing lateral rotation of the ankle joint without sacrificing high back support. The high back "floats" in the pocket instead of pivoting about a fixed point, giving greater comfort and control to the rider. It also has some limited front-to-back freedom of rotation in the pocket, allowing forward lean adjustment.

The adjustment forward lean strap or cable is mechanically connected at two points on opposite sides of the boot. It's position is also fixed relative to the top of the cuff/high back, but the boot cuff is free to slide along its length. This allows for adjustment of the cable or strap on only one side of the boot, and also allows greater lateral boot flexibility without sacrificing support. The forward lean strap system is coupled to the top of the high back in such a way as to transfer load from the forward lean strap to the high back, so that when the rider applies force backwards to the top of the boot (by leaning backwards for a back side or heel side turn), the applied force is balanced by the opposing horizontal component of the tension in the forward lean strap, while the compression in the high back balances the vertical component of the strap tension.

Unlike the fixed pivot ankle support insert designs of the prior art, the free floating coupling between the bottom end of the high back support and the heel cup permits the bottom end of the high back to move vertically upwards within the pocket when tension in the straps slackens. This situations occurs, for example, during toe side turns where the rider leans forward to shift weight to the toe side edge of the snowboard. The free floating coupling feature advantageously allows the upper part of the high back support to move upwardly and forwardly as needed to more closely follow the complex articulation of the rider's ankle and calf region during toe side turns.

The invention preferably includes restricting means for restricting the range of vertical movement of the high back with respect to the heel cup so as to prevent inadvertent decoupling of the bottom end of the high back from the heel cup pocket. The restricting means may include, for example, a tether or leash for anchoring the high back to the heel cup. Other solutions which provide the equivalent restricting function may include, but not be limited to: (1) sewing or otherwise affixing the high back to the boot inner liner material; (2) providing engagement or abutment structure (e.g. tabs, lips, stops, etc.) on mutually facing surfaces of the heel cup pocket and the bottom end of the high back; and (3) configuring the coupling between the heel cup pocket and bottom end of the high back as a "loose pin within a pin hole" type coupling, wherein the heel cup pocket includes a narrow neck and wide bottom and the bottom end of the high back is fashioned as a bulbous member adapted for one way insertion within the narrow neck so that it rides within the wide bottom end of the heel cup pocket.

The heel cup pocket is preferably dimensioned to provide the bottom end of the high back a desired amount of translation or movement in the transverse (side-to-side) and longitudinal (fore-aft) directions of the ankle support device. The range of motion provided by the appropriately dimensioned pocket is sufficient to permit the pivot axis at the bottom end of the high back support to shift or float in the transverse and longitudinal axis of the boot as needed in order to more closely approximate the articulation of the rider's ankle during side to side shifting or rolling motions of the ankle.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appending claims.

BRIEF DESCRIPTION OF THE DRAWING VIEWS

DETAILED DESCRIPTION OF THE PREFERRED EMBODIMENTS

Figure 1:
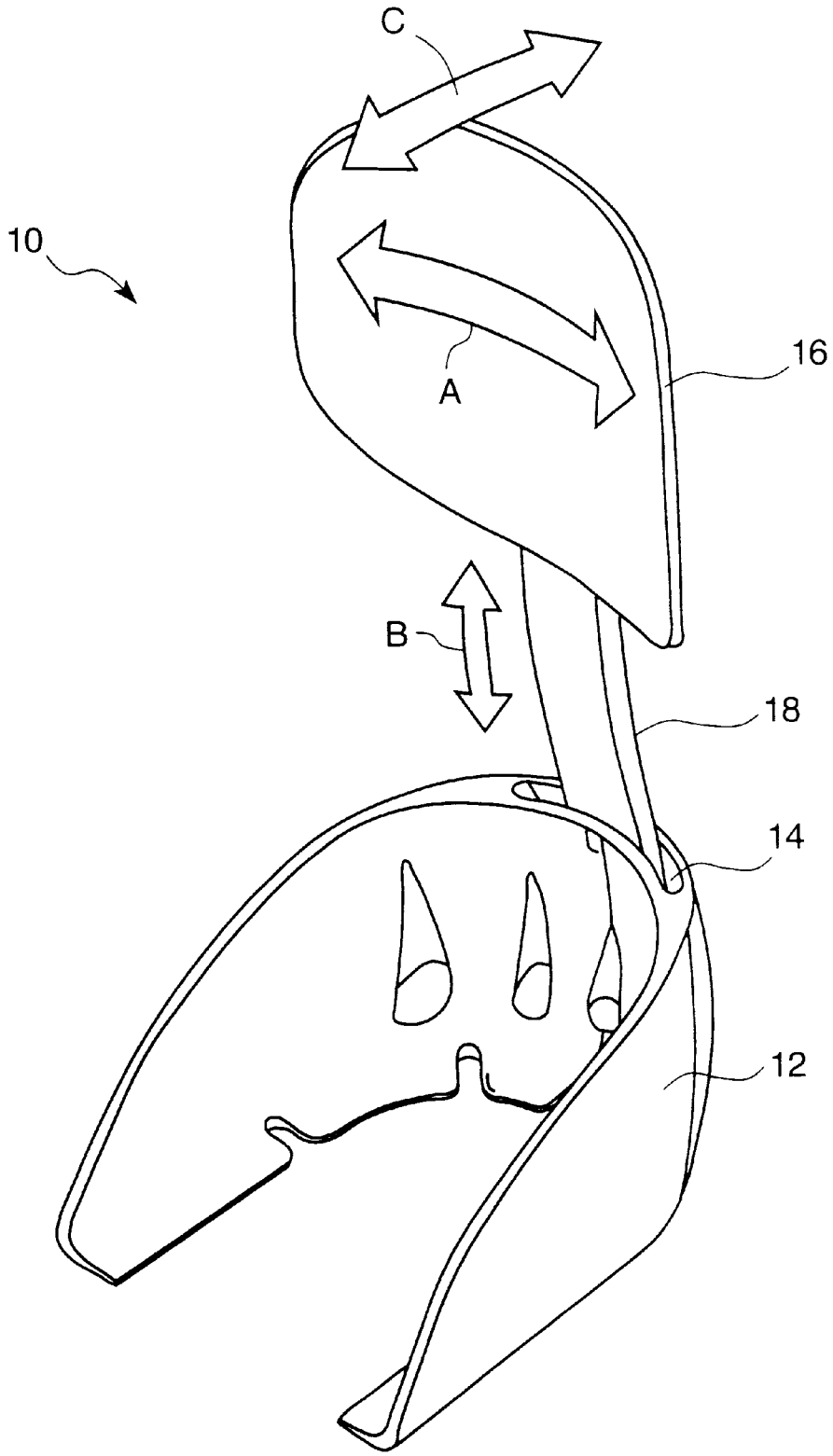
FIG. 1 is a perspective view of the ankle support device of the present invention.

With reference to the FIG. 1, there is shown an ankle support assembly 10 constructed in accordance with one embodiment of the present invention.

The ankle support assembly 10 includes a rigid molded heel cup 12 with a slot or pocket 14 formed in the top rear surface of the heel cup. The heel cup pocket 14 provides "floating" support to the high back, but is also designed to locate and hold the heel in a fixed position, preventing "heel lift" which is detrimental to the control of the system.

The ankle support assembly 10 further includes a rigid or partially rigid high back support 16 having a narrow, rounded bottom end member 18 adapted for coupled insertion within the heel cup pocket 14. Since the bottom end member 18 is not mechanically fixed to the heel cup 12, and since the pocket 14 is larger than the bottom end of the high back, the high back 16 is free to rotate laterally (as indicated by directional arrow A) and shift vertically (as indicated by directional arrow B), thereby giving greater control and freedom of movement to the rider. The high back 16 "floats" in the pocket 14 instead of pivoting about a fixed point. Because of this, the assembly 10 articulates in a manner that closely approximates the actual articulation of the foot and ankle, thereby providing more comfort and freedom than a fixed pivoting assembly. In addition, the movable "axis of rotation" is significantly lower than the axis of rotation in the fixed pivoting ankle support systems of the prior art, thus allowing the system of the present invention to more closely mimic the ankle's true action. The pocket width is also designed to be greater than the thickness of the bottom end 18 of the high back 16 so that some front-to-back rotation of the high back 16 is also accommodated (as indicated by directional arrow C). This allows for adjustment of the forward lean of the boot.

Figure 2:
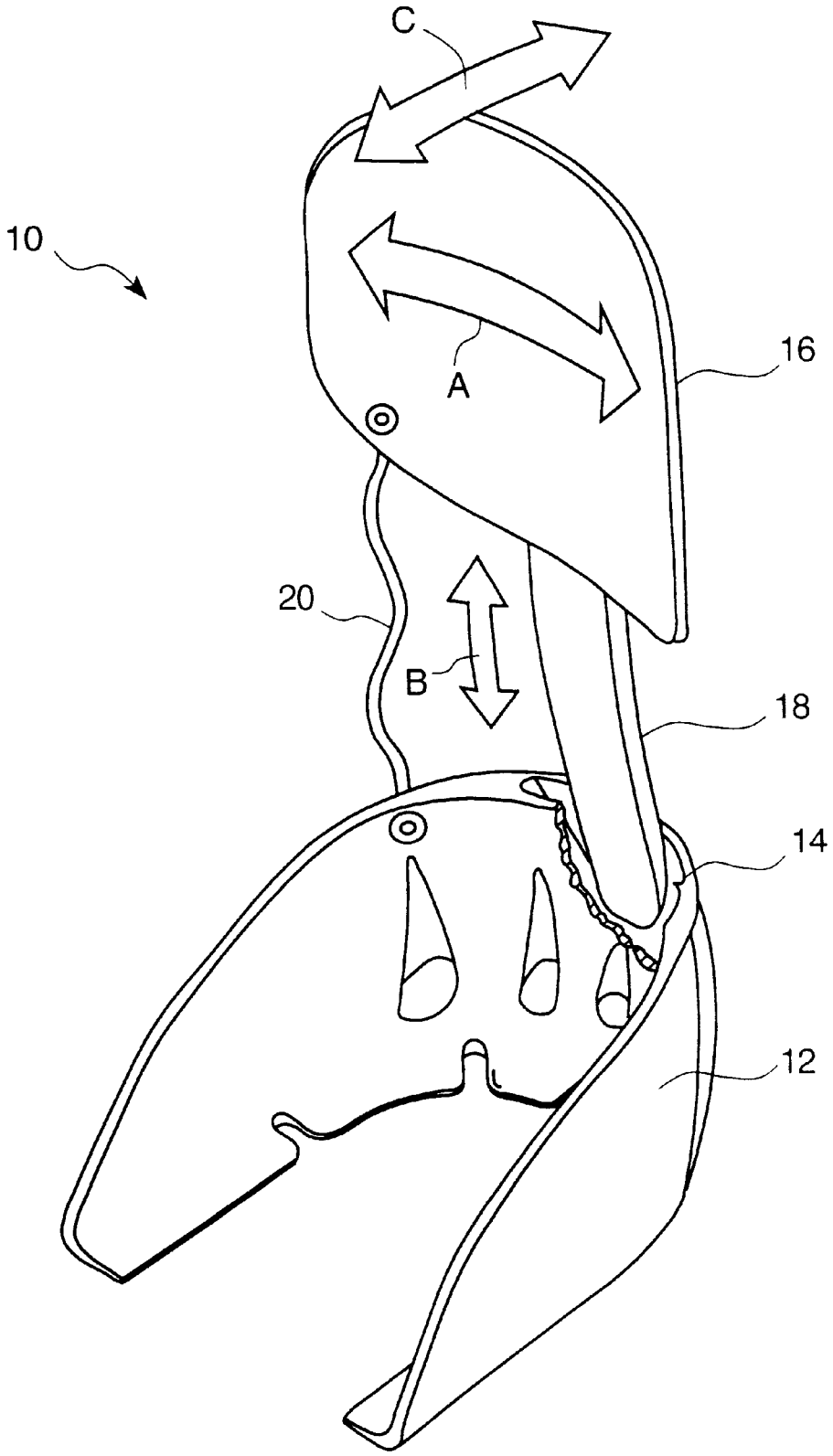
FIG. 2 is a perspective view of the invention similar to that as shown in FIG. 1, except that the heel cup is shown in partial section view to illustrate the floating coupling feature between the high back and heel cup. The tether feature is also shown.

With reference to FIG. 2, the ankle support device 10 preferably includes a leash 20 connected between the high back support 16 and heel cup 12 to restrain or limit the total upward range of motion of the high back support or spoiler 18. The leash 20 prevents the inadvertent decoupling of the high back 16 from the heel cup 12.

Figure 3:
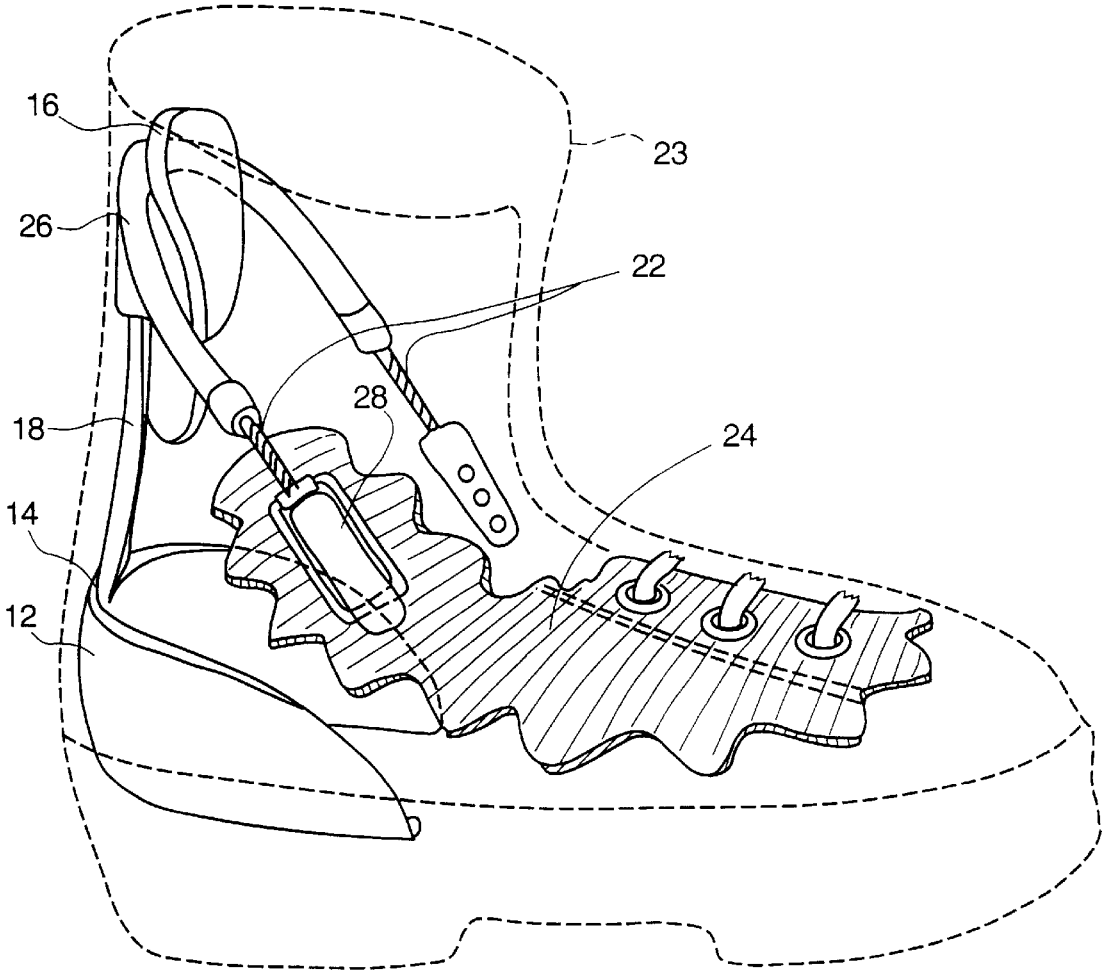
FIG. 3 is a perspective view of the ankle support device as shown installed within a soft-style snowboard boot (shown in partial phantom).

With reference to FIG. 3, the ankle support device 10 may include a length adjustable cable or strap 22 for forward lean control. In this figure, the ankle support assembly 10 is shown fitted within a soft-style snowboard boot 23 (shown in phantom). The opposite ends of the cable or strap 22 are attached to the respective opposite sides of the boot upper 24 at two locations on opposite sides of the foot. The cable 22 is directed through a guide 26 that goes around rear of the high back support 16. The cable 22 includes a length adjustable locking mechanism 28 that allows for adjustment of the forward lean of the boot. The above-described connection of the length adjustable cable 22 to the boot upper 24 and high back 16 permits the boot cuff/high back to slide freely along the length of the cable 22 to allow lateral flexing about the ankle joint with no loss of high back support. This could also be accomplished in either of the following ways, each comprising a separate design. In each case the forward lean system and the high back would be securely connected, so that the vertical component of the strap/cable tension would be balanced by compression in the high back.

1. Using a strap, this could be accomplished with a low profile D ring (or equivalent) attached to the boot cuff/high back, through which D-ring the strap would pass. The boot cuff would thus be supported by the strap, and would also be able to move laterally as the D-ring would slip along the strap.

2. Using a cable, this could be accomplished using a sheath sewn into the top of the boot cuff, through which the cable would pass. The cable would thus support the cuff while the cuff would be free to slide along the cable.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

What is claimed is:

1. An ankle support assembly for use in combination with a soft-style snowboard boot and which is effective to provide improved support and motion control for the foot and ankle region of the snowboard rider, comprising:

a) a rigid heel cup;

b) a high back support for supporting the calf region of the snowboard rider, said high back support including an extension member extending downwardly in the direction of said heel cup; and c) coupling means for coupling said extension member of said high back support to said heel cup in a free floating manner which permits said high back support to pivot about a pivot axis that is translatable a predetermined amount along transverse, longitudinal and vertical axes of the ankle support device so as to enable articulation of said ankle support assembly in a manner that closely approximates the articulation of the foot and ankle of the snowboard rider.

2. An ankle support assembly according to claim 1, wherein said coupling means includes a pocket formed along an upper rear surface of said heel cup.

3. An ankle support assembly according to claim 1, which further includes restraint means for restraining the amount of vertical translation of said high back support to prevent inadvertent decoupling of said high back support from said heel cup.

4. An ankle support assembly according to claim 1, which further includes restraint means for restraining the amount of vertical translation of said high back support to prevent inadvertant decoupling of said high back support from said heel cup.

5. An ankle support assembly according to claim 4, wherein said restraint means includes a tether connected between said high back support and said heel cup.

6. An ankle support assembly according to claim 1, which further includes a length adjustable cable routed around said high back support an having opposite ends attached to respective opposite sides of the snowboard boot upper at the location of the ball of the foot, said cable effective to set a forward lean adjustment of said high back support.

7. An ankle support assembly according to claim 1, wherein said ankle support assembly is fashioned as an insert for a soft-style snowboard boot.

8. An ankle support assembly according to claim 1, wherein said ankle support assembly is positioned between a flexible outer boot portion and padded inner boot portion of a soft-style snowboard boot.

9. An ankle support assembly for use with a snowboard boot, comprising:

a heel cup including a pocket formed on an upper rear surface; and a high back support having a rounded bottom end which couples to the pocket such that the high back floats to permit a predetermined amount of rotation in a lateral direction and a predetermined amount of sliding in a substantially vertical and horizontal direction.

10. The assembly of claim 9, further comprising a forward lean strap slidably coupled to the top of the high back and mechanically connected at two points on opposite sides of the snowboard boot.

11. The assembly of claim 9, further comprising a restriction structure to limit the range of vertical movement of the high back.

12. The assembly of claim 11, wherein the restriction structure affixes the high back to a boot liner of the snowboard boot.

13. An ankle support assembly to provide support for a soft-style sport boot, comprising:

a high back support element;

an extension member having a first end connected to the high back element, and having a second rounded end; and a rigid heel cup having a pocket for securely retaining the rounded end of the extension member in a free floating manner, to enable articulation of the ankle support assembly in response to the movement of an ankle during use of the sport boot.

14. The assembly of claim 13, further comprising a forward lean strap slidably coupled to the top of the high back and mechanically connected at two points on opposite sides of the sports boot.

15. The assembly of claim 13, further comprising a restriction structure for limiting vertical movement of the high back.

16. The assembly of claim 15, wherein the restriction structure affixes the high back to a boot liner of the sports boot.

* * * * *